United States Patent [19]

Wright et al.

[11] 4,367,152

[45] Jan. 4, 1983

[54] SELECTED HETEROAROMATIC NITROGEN COMPOUNDS AS ANTIOXIDANT/METAL DEACTIVATORS/ELECTRICAL INSULATORS IN LUBRICATING OILS AND PETROLEUM LIQUID FUELS

[75] Inventors: Peter G. Wright; John M. MacDonald; Gerald A. MacAlpine, all of Sarnia, Canada

[73] Assignee: Exxon Research and Engineering Co., Florham Park, N.J.

[21] Appl. No.: 280,073

[22] Filed: Jul. 2, 1981

[51] Int. Cl.[3] ..... C10L 1/18; C10L 1/22; C10M 1/20; C10M 1/32

[52] U.S. Cl. ..... 252/47.5; 252/47; 252/50; 252/51.5 R; 252/401; 44/63; 544/264

[58] Field of Search ..... 252/47, 47.5, 50, 51.5 R, 252/401; 44/63; 544/264

[56] References Cited

U.S. PATENT DOCUMENTS

| | | | |
|---|---|---|---|
| 1,768,910 | 7/1930 | Ihrig . | |
| 2,136,788 | 11/1938 | Fairlie | 87/9 |
| 2,377,423 | 6/1945 | Howland et al. | 260/800 |
| 2,647,824 | 8/1953 | Jones et al. | 44/63 |
| 3,190,835 | 6/1965 | Brezesinska et al. | 252/47 |
| 3,197,475 | 7/1965 | Carboni | 260/308 |
| 3,591,500 | 7/1971 | Sullivan | 252/51.5 R |
| 3,597,353 | 8/1971 | Randell et al. | 252/50 |
| 3,720,616 | 3/1973 | Randell et al. | 252/51.5 R |
| 3,785,977 | 1/1974 | Flowerday et al. | 252/33.6 |
| 3,920,678 | 11/1975 | Butula | 252/401 X |
| 3,969,237 | 7/1976 | Andress | 252/49.9 |
| 3,987,054 | 10/1976 | Butula | 260/309 |
| 4,162,225 | 7/1979 | Braid | 252/50 |

OTHER PUBLICATIONS

C. V. Smalheer and R. K. Smith, "Lubricant Additives", 1967, pp. 7 and 72.

*Primary Examiner*—W. J. Shine

*Attorney, Agent, or Firm*—Eugene Zagarella, Jr.

[57] ABSTRACT

A hydrocarbon composition such as a lubricating or specialty oil containing a selected heteroaromatic nitrogen compound as an antioxidant/metal deactivator-/electrical insulator having the following general formula:

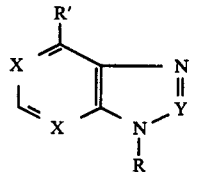

wherein each X is C or N with at least one X being N; Y is C or N; R is H or $CH_2NR'''_2$ where each R'' is H or alkyl of 1 to 20 carbons; R' is H, SR''' OR ''' or $NR'''_2$ with each R''' being H or alkyl of 1 to 20 carbons.

11 Claims, No Drawings

SELECTED HETEROAROMATIC NITROGEN COMPOUNDS AS ANTIOXIDANT/METAL DEACTIVATORS/ELECTRICAL INSULATORS IN LUBRICATING OILS AND PETROLEUM LIQUID FUELS

BACKGROUND OF THE INVENTION

This invention relates to hydrocarbon compositions containing selected heteroaromatic nitrogen compounds as antioxidant/metal deactivators/electrical insulators and particularly to lubricant and specialty oil compositions such as electrical insulating oils containing such compounds.

The use of antioxidant/metal deactivators in hydrocarbon compositions such as lubricants and specialty oils and in other applications has been widespread for a good many years. Some of the representative types of antioxidants used in lubricating oils are noted in "Lubricant Additives" by C. V. Smalheer and R. K. Smith, 1967, pp. 7, including hindered phenols such as 2,6-ditertiary-butyl-4-methyl phenol and amines such as N-phenyl alpha naphthylamine.

A variety of nitrogen containing compounds have been disclosed useful as antioxidants. U.S. Pat. No. 1,768,910 discloses the use of compounds such as pyridine, quinoline and piperidine; U.S. Pat. No. 2,136,788 discloses the use of quinaldine; U.S. Pat. No. 2,377,423 discloses the product of a diene and an aromatic amine such as 1,3 butadiene and p,p' diamino diphenyl methane; U.S. Pat. No. 2,647,824 discloses the combination of a hydrogenated quinoline and an amino phenol; U.S. Pat. No. 3,190,835 discloses a di-substituted isoindoline compound; a variety of benzotriazole compounds are disclosed in U.S. Pat. Nos. 3,197,475, 3,597,353, 3,720,616, 3,969,237 and 4,162,225; U.S. Pat. No. 3,785,977 discloses a variety of amine and triazine compounds as antioxidants and U.S. Pat. Nos. 3,920,678 and 3,987,054 disclose 4, 5, 6, 7-tetrahydrobenzimidazoles as corrosion inhibitors and metal deactivators.

Despite the variety of known antioxidant/metal deactivator-type compounds that are available, there is always the need and desire to find additional compounds having improved properties particularly ones that have antioxidant/metal deactivator properties as well as good electrical insulating properties and are especially useful in specialty-type applications such as electrical insulating oils.

SUMMARY OF THE INVENTION

Now in accordance with this invention it has been found that selected heteroaromatic nitrogen compounds such as purine are particularly useful as antioxidants/metal deactivators/electrical insulators in hydrocarbon compositions and especially lubricating and specialty oil compositions such as electrical insulating oils.

DETAILED DESCRIPTION OF THE INVENTION

This invention is directed to the use of selected heteroaromatic nitrogen compounds as antioxidant/-metal deactivators/electrical insulators in hydrocarbon compositions. More particularly, the selected antioxidant/metal deactivator/electrical insulator compounds of this invention are of a type having the following general formula:

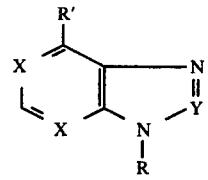

(I)

wherein each X is C or N with at least one X being N; Y is C or N; R is H or $CH_2NR''_2$ where each R'' is H or alkyl of 1 to 20 carbons; R' is H, SR''', OR''' or $NR''_2$ where each R''' is H or alkyl of 1 to 20 carbons. Preferably, both X groups will be N, Y will be C, and the alkyl groups in R'' and R''' will contain 8 to 16 carbon atoms. Additional substituent groups, for example, alkyl groups, may be added at other places on the ring structure (I) and other types of substituents besides those noted above may also be used to provide such compounds (I) with the desired oil solubility.

Illustrative compounds of the type identified by the general formula (I) include purine, 6-aminopurine, 4-azabenzimidazole, 8-azaadenine, 6-octylthiopurine, 6-decylthiopurine, 9-diethylaminomethylpurine, 9-butylaminomethylpurine, 9-dioctylaminomethylpurine and 9-didodecylaminomethylpurine. Particularly preferred is purine and derivatives thereof.

The antioxidant/metal deactivators/electrical insulators defined by general formula (I) may be used in any hydrocarbon composition as the base composition and more particularly in lubricating and specialty oils and petroleum fuels.

Included in the base compositions which may utilize the antioxidant/metal deactivators/electrical insulators (I) are conventional hydrocarbon oils of lubricating viscosity including mineral or synthetic lubricating oils. The lubricating oils employed may be of any suitable lubricating viscosity and may range from about 30 to about 7,500 SUS at 100° F. Particularly useful as the base compositions in this invention are lubricating and specialty oils, preferably electrical insulating oils such as transformer oils which have relatively low viscosity values and more particularly a viscosity of 40 to 100 SUS at 100° F.

The fuel compositions which are useful as base compositions include petroleum distillate fuels and oils and are not restricted to straight-run fuels and oils but can comprise straight-run distillates, catalytically or thermally cracked distillate fuels or mixtures of straight-run distillate fuel oils, naphthas and the like, with cracked distillate fuels. Moreover, such fuels and oils can be treated in accordance with well known commercial methods such as acid or caustic treatment, hydrogenation, solvent refining, clay treatment, etc.

Particularly contemplated, among the fuels and fuel oils are those boiling in the gasoline range, jet fuels, domestic fuel oils such as No. 1, 2 and 3 fuel oils used in heating and as diesel fuel oils and turbine fuels. The domestic fuel oils generally conform to the specifications set forth in ASTM Specification D396-48T. Specifications for diesel fuels are defined in ASTM Specification D975-48T. Typical jet fuels are defined in Military Specification MIL-F-5624B.

The preferred base or basestock compositions are the mineral oils and more particularly those of lubricating viscosity, especially those useful as lubricating and specialty oils such as electrical insulating oils. Further description of lubricating oils useful as the base composition may be found in Kirk-Othmer, Encyclopedia of Chemical Technology, 2nd Edition, Vol. 12, 1967, pp. 557 to 616.

The base hydrocarbon composition will make up a major portion by weight of the compositions of this invention with the antioxidant/metal deactivator/electrical insulator comprising an effective inhibitive amount. More particularly, the antioxidant/metal deactivator/electrical insulator will comprise from about 0.0001 to about 1.0 percent by weight and preferably from about 0.001 to about 0.05 percent by weight, based on the total weight of the composition.

Other conventional type additives may also be added to the hydrocarbon base composition containing the antioxidant/metal deactivator/electrical insulator (I) in accordance with this invention depending on the particular application of said composition. Such additives, for example, include dispersants, extreme pressure additives, pour point depressants and also other known antioxidants such as 2,6-ditertiary butyl para cresol. Additional disclosures of useful additives may be found in "Lubricant Additives" by C. Smalheer et al. described above.

The following examples are further illustrative of this invention and are not intended to be construed as limitations thereof.

EXAMPLE I

A refined electrical insulating oil which was essentially a mineral oil having a viscosity of 58 SUS at 100° F. was formulated with 0.06 weight percent of 2,6-ditertiary butyl para cresol. Using the Rotating Bomb Test (ASTM D-2112) its life was found to be 109 minutes. Sludge formation and soluble acidity buildup was also determined using the D-2440 oxidation test (164 hrs.).

The same electrical insulating oil but containing 0.01% by weight of purine was also tested for life using the Rotating Bomb Test (ASTM D-2112) and showed a significant increase in life to 190 minutes. Carrying out the D-2440 oxidation test for this oil containing purine, a significant retardation of sludge formation and soluble acidity buildup was demonstrated.

EXAMPLE II

An electrical insulating oil of the same composition as in Example I containing 0.3 percent by weight of 2,6-ditertiary butyl para cresol was formulated with 0.054% of 6-aminopurine. This composition showed a significant reduction of 62% in the depletion of phenol component (compared with the composition without the aminopurine) in the first day of a copper catalyzed oxidation test. This test was run in accordance with ASTM D2440 conditions except at 120° C.

EXAMPLE III

An electrical insulating oil of the same composition as Example I was formulated with 0.06 wt. % of 2,6-ditertiary butyl para cresol and 0.015 wt. % of 4, 5, 6, 7 tetrahydrobenzotriazole (formerly sold commercially by Ciba-Geigy as Reomet SBT). Carrying out the D-2440 oxidation test (164 hours), results indicated 0.16 wt. % sludge and an acid number of 1.70 mg KOH/g. In comparison the base electrical insulating oil without the benzotriazole compound gave a sludge weight of 0.85% and acid number of 3.45.

A similar sample of electrical insulating oil but with 0.005% by weight of 4-azabenzimidazole instead of 0.015 wt. % of the benzotriazole compound gave significantly improved oxidation results for the D-2440 test of 0.02 wt. % sludge and nil for the acid number.

EXAMPLE IV

A refined electrical insulating oil as in Example I was formulated with 0.06 weight percent of 2,6-ditertiary butyl para cresol. Testing on the Rotating Bomb test (ASTM D-2112) showed its life to be 196 minutes.

An addition of 0.054 wt. % of 8-azaadenine to the above formulation was made resulting in an increased life to 440 minutes on the ASTM D-2112 test. This illustrates the significant antioxidant/metal deactivator properties of this additive.

EXAMPLE V

An electrical insulating oil as in Example I containing 0.06 wt. % of 2,6-ditertiary butyl para cresol and 0.07 wt. % of a pour point depressant which was a chlorinated wax/naphthalene condensation product dissolved in solvent mineral oil and having a chlorine content of about 0.5 wt. % or less was formulated and tested for oxidation using the ASTM D-2440 (24 hour) test which showed moderate sludge formation, an acid number of 1.46 mg KOH/g and an interfacial tension of 10.4 (mN/m). The 164 hr. ASTM D-2440 test showed a 0.8 wt. % sludge and 3.46 acid number.

In comparison with this, the same formulation with 0.015 wt. % of dialkyl aminomethyl benzotriazole sold commercially by Ciba-Geigy as Reomet 38 gave no sludge, nil for acid number and an interfacial tension of 27.9 on the 24 hr. D-2440 test and a sludge of 0.14 wt. % and an acid number of 1.53 for the 164 hr. D-2440 oxidation test. Another similar sample with 0.005 wt. % of the benzotriazole compound resulted in no sludge, nil for acid number and an interfacial tension of 30.2 on the 24 hr. D-2440 test and a sludge wt. % of 0.23 and an acid number of 2.64 for the 164 hr. D-2440 test.

Using 0.005 wt. % of 6-octylthiopurine in place of the benzotriazole compound resulted in no sludge formation, an acid number of 0.03 and interfacial tension of 27.8 for the D-2440 24-hour test and a sludge weight % of 0.04 and an acid number of 0.27 for the 164 hr. ASTM D-2440 test.

In comparison with this, the same formulation with 0.005 wt. % of 1-thia-2,5-alkylthio 3,4 diazole (sold commercially as Amoco 150) instead of the 6-octylthiopurine was tested with the following results. The ASTM D-2440 test (24 hour) showed moderate sludge, 2.84 acid number and an interfacial tension of 9.8.

Using 0.0025 wt. % of the 6-octylthiopurine in the formulation resulted in no sludge, 0.02 acid number and 29.6 interfacial tension for the D-2440 (24 hour) test and sludge of 0.08 wt. % and an acid number of 0.60 for the 164 hr. D-2440 test.

EXAMPLE VI

The same formulation as in Example V was tested using 0.0025 wt. % of 9-dibutylaminomethylpurine instead of the octylthiopurine, with the following results.

No sludge, nil for acid number and interfacial tension of 31.4 for the 24 hour ASTM D-2440 test.

A 0.01 wt. % for sludge and an acid number of 0.06 for the 164 hour test.

Using 0.00125 wt. % of the 9-dibutylaminomethylpurine gave the same results for the 24 hour test and a 0.05 wt. % sludge and 0.46 acid number for the 164 hour test.

EXAMPLE VII

An electrical insulating oil as in Example V containing 0.08 wt. % of the 2, 6-ditertiary butyl para cresol and 0.07 wt. % of the chlorinated wax/naphthalene pour point depressant was formulated and tested for oxidation using the ASTM D-2440 (164 hr.) test which showed a 0.39 wt. % sludge and 2.10 acid number.

In comparison with this, the same formulation with 0.025 wt. % of 1-dialkylaminomethyl benzotriazole (Reomet 38) gave 0.06 wt. % sludge and an acid number of 0.61.

Using 0.005 wt. % of 9-dioctylaminomethylpurine in place of the benzotriazole compound resulted in 0.02 wt. % sludge and an acid number of 0.06.

EXAMPLE VIII

The same formulation as in Example VII was tested using 0.005 wt. % of 9-didodecylaminomethylpurine.

The D-2440 oxidation test (164 hours) resulted in 0.01 wt. % sludge and an acid number of 0.04.

EXAMPLE IX

Similar electrical insulating oils to those above were formulated and tested to show the improved electrical properties when using the compounds of formula (I).

The oil to be tested was a refined electrical insulating oil which was essentially a mineral oil having a viscosity of 8.68 cSt at 40° C. containing 0.06 wt. % of 2,6-ditertiary butyl para cresol and 0.07 wt. % of the chlorinated wax/naphthalene pour point depressant described in Example V.

Two electric breakdown tests were conducted on the oil sample using uniform field brass electrodes under 60 Hz and switching surge voltages with the test cell maintained at 65° C.

The 60 Hz test was conducted by applying a voltage approximately 30% below the expected breakdown for one minute. If no breakdown occurred, the voltage was increased by 5% and again held for one minute. The procedure was repeated until breakdown occurred. Ten breakdowns were observed using fresh oil charges each time with the resulting mean breakdown voltage of 43.6 kV (standard deviation 6.9).

Using the same oil with the addition of 50 ppm (0.005 wt. %) of purine, the resulting mean breakdown voltage was 54.1 kV (std. deviation 1.4).

A switching surge test was conducted on the same test oils by applying a surge voltage with a rise time of 200 microseconds and a tail length of 1,000 microseconds. The first voltage application was at approximately 30% below the expected breakdown voltage. If no breakdown occurred, the voltage was applied three times at that level and then increased by 5%. This procedure was repeated until breakdown occurred with the peak value of the surge voltage that produced breakdown recorded. Ten breakdowns were observed using fresh oil each time with the resulting mean breakdown voltage of 50.9 kV (std. deviation 8.6).

Using the same oil with the addition of 50 ppm (0.005 wt. %) of purine, the resulting mean breakdown voltage for the switching surge test was 48.6 kV (std. deviation 2.3).

Oxidation properties for the two oils were also determined using the ASTM D-2440 (164 hour) test with the oil alone giving 0.76 wt. % sludge and an acid number of 3.07 and the oil containing purine giving a 0.01 wt. % sludge and an acid number of nil.

This example illustrates that the compounds of the type defined by formula I not only improve the antioxidant/metal deactivator properties of the hydrocarbon compositions to which they are added, but also provide satisfactory electrical insulating properties and in the case of the 60 Hz electric breakdown test, showed an improvement in the electrical insulation properties and in effect acted as an electrical insulator.

The results disclosed in the several examples above show the particularly desirable oxidation properties of the compounds of the type defined by formula (I) and also show the desirable electrical insulating properties of such compounds when added to hydrocarbon compositions such as mineral oils.

What is claimed is:

1. A hydrocarbon composition comprising a basestock of hydrocarbon oil of lubricating viscosity or a petroleum liquid fuel and effective inhibitor amount of an antioxidant/metal deactivator/electrical insulator of the formula:

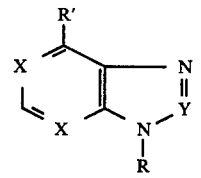

wherein each X is C or N with at least one X being N; Y is C or N; R is H or $CH_2NR''_2$ where each R'' is H or alkyl of 1 to 20 carbons; R' is H, SR''', OR''' or $NR'''_2$ with each R''' being H or alkyl of 1 to 20 carbons.

2. The composition of claim 1 wherein said antioxidant/metal deactivator/electrical insulator is used in an amount of from about 0.0001 to about 1.0 percent by weight based on the total weight of the composition.

3. The composition of claim 2 wherein both X groups are N.

4. The composition of claim 3 wherein Y is C.

5. The composition of claim 4 wherein said basestock is a mineral oil.

6. The composition of claim 5 wherein said composition is an electrical insulating oil additionally containing a small additive amount of 2,6-ditertiary butyl para cresol.

7. The composition of claim 5 wherein said antioxidant/metal deactivator/electrical insulator is used in an amount of from about 0.001 to about 0.05 percent by weight.

8. The composition of claim 6 wherein the alkyl groups in R'' and R''' contain 8 to 16 carbon atoms.

9. The composition of claim 2 wherein said antioxidant/metal deactivator/electrical insulator is selected from the group consisting of purine, 6-aminopurine, 4-azabenzimidazole, 8-azaadenine, 6-octylthiopurine, 6-decylthiopurine, 9-diethylaminomethylpurine, 9-dibutylaminomethylpurine, 9-dioctylaminomethyl purine and 9-didodecylaminomethylpurine.

10. The composition of claim 8 wherein said basestock is a mineral oil and said antioxidant/metal deactivator/electrical insulator is used in an amount of from about 0.001 to about 0.05 percent by weight.

11. The composition of claim 9 wherein said composition is an electrical insulating oil additionally containing a small additive amount of 2,6-ditertiary butyl para cresol.

* * * * *